US008794795B2

(12) United States Patent
Yaphe et al.

(10) Patent No.: US 8,794,795 B2
(45) Date of Patent: Aug. 5, 2014

(54) ADJUSTABLE LED ASSEMBLY, OPTICAL SYSTEM USING SAME AND METHOD OF ASSEMBLY THEREFOR

(75) Inventors: Howard Yaphe, Saint Laurent (CA); Adrian Nisel, Pierrefonds (CA)

(73) Assignee: Axis Lighting Inc., Montreal, Quebec (CA)

( * ) Notice: Subject to any disclaimer, the term of this patent is extended or adjusted under 35 U.S.C. 154(b) by 152 days.

(21) Appl. No.: 13/601,562

(22) Filed: Aug. 31, 2012

(65) Prior Publication Data

US 2014/0063803 A1 Mar. 6, 2014

(51) Int. Cl.
*F21V 21/00* (2006.01)

(52) U.S. Cl.
USPC ..... 362/249.03; 362/217.01; 362/249.1

(58) Field of Classification Search
USPC ..... 362/249.03, 249.07, 249.1, 217.01, 220
See application file for complete search history.

(56) References Cited

U.S. PATENT DOCUMENTS

| | | | | |
|---|---|---|---|---|
| 5,927,845 | A | 7/1999 | Gustafson et al. | |
| 6,673,293 | B1 | 1/2004 | Mistopoulos et al. | |
| 7,175,329 | B1 * | 2/2007 | Chou | 362/612 |
| 7,712,918 | B2 | 5/2010 | Siemiet et al. | |
| 8,096,683 | B1 | 1/2012 | Burrell, IV | |
| 2004/0109330 | A1 * | 6/2004 | Pare | 362/559 |
| 2009/0135597 | A1 | 5/2009 | Kay | |
| 2009/0207602 | A1 | 8/2009 | Reed et al. | |
| 2010/0246181 | A1 * | 9/2010 | Fang et al. | 362/257 |
| 2011/0273877 | A1 | 11/2011 | Reed et al. | |

* cited by examiner

*Primary Examiner* — Ali Alavi
(74) *Attorney, Agent, or Firm* — Weaver Austin Villeneuve & Sampson LLP

(57) ABSTRACT

Described are various embodiments of a length adjustable LED assembly, optical system using same, and method of assembly therefor. In one embodiment, an optical system comprises a first LED and second LED board each comprising a plurality of LEDs operatively mounted thereon along their respective lengths in accordance with a designated array. The second LED board is adjustably fixable in lengthwise overlapping relationship to the first LED board to provide a length adjustable extension thereto and substantially continuously maintain an optical system output over a combined length of the first LED board and the second LED board.

22 Claims, 7 Drawing Sheets

ADJUSTABLE LED ASSEMBLY, OPTICAL SYSTEM USING SAME AND METHOD OF ASSEMBLY THEREFOR

FIELD OF THE DISCLOSURE

The present disclosure relates to light sources, and in particular, to an adjustable LED assembly, optical system using same, and method of assembly therefor.

BACKGROUND

LED light sources are well known in the art to provide efficient lighting solutions in various configurations and for various applications. In the provision of a substantially linear LED lighting system, one or more prefabricated LED boards are juxtaposed end-to-end within a housing to radiate light through an output lens. Different light source lengths are generally provided by combining different numbers of prefabricated boards, or again by juxtaposing prefabricated boards of different lengths. Accordingly, dimensions in custom applications are generally limited to the types and sizes of prefabricated LED boards available in the market.

Therefore, there remains a need for an adjustable LED assembly, optical system using same, and method of assembly therefor, that overcome some of the drawbacks of known techniques, or at least, provides the public with a useful alternative.

This background information is provided to reveal information believed by the applicant to be of possible relevance. No admission is necessarily intended, nor should be construed, that any of the preceding information constitutes prior art.

SUMMARY

Some aspects of this disclosure provide an adjustable LED assembly, optical system using same, and method of assembly therefor. In accordance with one embodiment of the invention, there is provided an optical system comprising: a first LED module comprising a plurality of LEDs operatively mounted thereon in accordance with a designated array; and a second LED module comprising a plurality of LEDs operatively mounted thereon in accordance with said designated array; said second LED module adjustably fixable relative to said first LED module in sliding overlapping relationship to provide an adjustable extension thereto and substantially continuously maintain an optical system output over a combination of said first LED module and said second LED module.

In accordance with another embodiment, there is provided a modular LED light source comprising: a housing having a corresponding output optics; one or more fixed LED modules juxtaposed within said housing, each having a designated dimension and comprising a plurality of LEDs operatively mounted thereon in accordance with a designated array; an adjustable LED module having a designated dimension and comprising a corresponding array of LEDs operatively mounted thereon, said adjustable LED module adjustably fixed in sliding overlapping engagement relative to said fixed LED modules in providing a linearly adjustable extension to said designated LED array.

In accordance with another embodiment, there is provided a method for assembling a modular light source, comprising: locating an adjustable LED module at a first end within a light source housing having a given dimension, said adjustable LED module having a designated dimension and comprising an array of LEDs operatively mounted thereon recessed relative to adjustable housing engagement surfaces provided along either side thereof; locating one or more fixed LED modules juxtaposed from a second end of said housing, each having a designated dimension and comprising a corresponding array of LEDs operatively mounted thereon coplanar to fixed housing engagement surfaces provided along either side thereof, said fixed housing engagement surfaces located within said housing in sliding overlapping engagement with said adjustable housing engagement surfaces, thereby defining a substantially planar gap above underlapping LEDs of said adjustable module; securing said adjustable and fixed LED modules in overlapping engagement within said housing to accommodate said given dimension of said housing.

Other benefits and features will become more apparent upon reading of the following non-restrictive description of specific embodiments thereof, given by way of example only with reference to the accompanying drawings.

BRIEF DESCRIPTION OF THE FIGURES

Several embodiments of the present disclosure will be provided, by way of examples only, with reference to the appended drawings, wherein.

DETAILED DESCRIPTION

With reference to the disclosure herein and the appended figures, an adjustable LED assembly, optical system using same and method of assembly therefor will now be described, in accordance with different embodiments of the invention.

Figure 1:
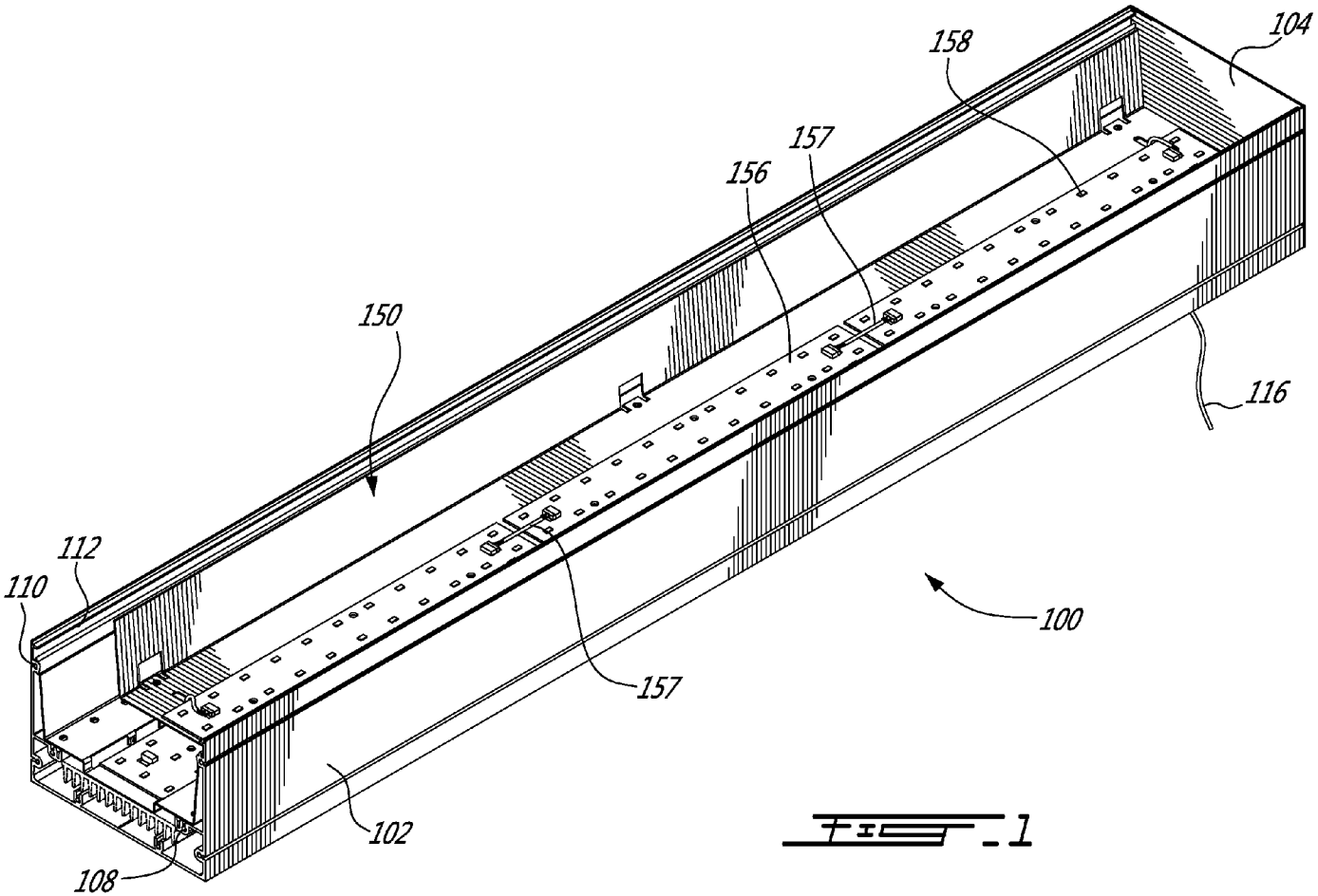
FIG. 1 is a perspective view of an optical system comprising an adjustable LED assembly, in accordance with one embodiment of the invention.
Figure 2:
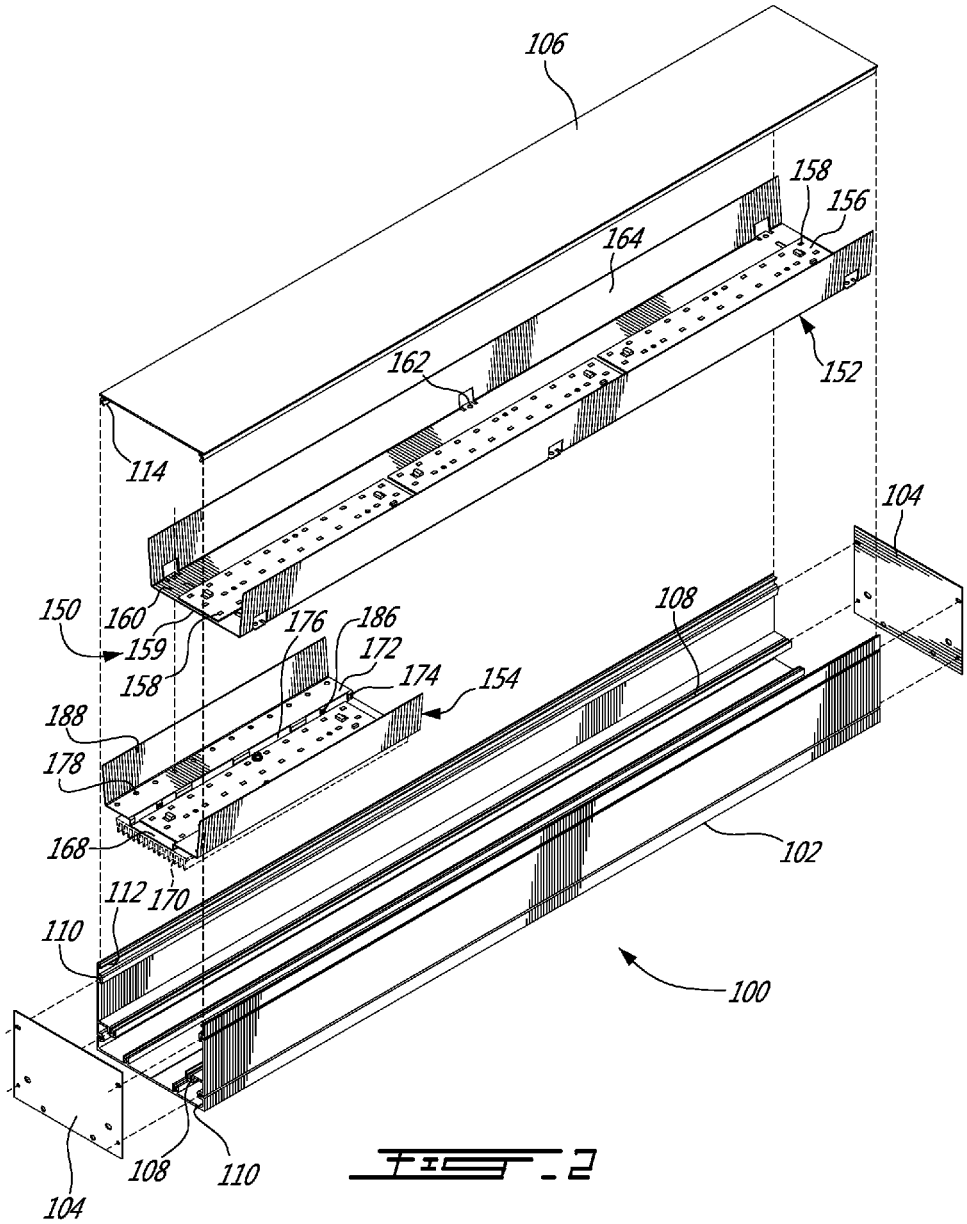
FIG. 2 is an exploded perspective view of the optical system of FIG. 1.

With reference to FIGS. 1 and 2, and in accordance with one embodiment, an optical system 100, comprising an adjustable LED assembly generally referenced using the numeral 150, will now be described. In this embodiment, the optical system 100 generally comprises an elongate generally U-shaped housing 102 in which are mounted the various components of the LED assembly 150, and upon which end caps 104 and an output optic 106 are respectively fixed to substantially encase the LED assembly 150 upon final installation.

The housing 102 can be manufactured of an extruded or otherwise shaped material, and in this particular embodiment, is shaped to have two support rails 108 defined along and on either side thereof to support the components of the LED assembly 150, while allowing sufficient room therebelow for the passage of appropriate wiring and/or ventilation, as will be readily appreciated by the skilled artisan. Additional grooves 110 also run along and on either side of the housing so to permit adequate fastening of the end caps 104 thereto.

An internally projecting lip 112 running along a length and on either side of the housing 102 is also defined toward an output thereof, to which a correspondingly shaped and sized resilient clipping element 114 running along a length of the output optics 106 may be releasably engaged to secure the output optics 106 to the housing 102. An external wiring orifice or the like (not shown) may also be provided to allow for hard-wiring 116 of the device to an external power source or the like, as can various mounting hardware (e.g. see bracket 118 of FIG. 4) be provided for securing the optical system 100 during installation, as will be readily appreciated by the skilled artisan. As will be further appreciated by the skilled artisan, different manufacturing processes may be considered in manufacturing the housing 102 depending on the material of interest, the intended application for which a particular optical system is being designed and/or configured, and other such considerations. Given the generic nature of the herein-illustrated housing design, however, one will readily appreciate the option to cut or trim the housing 102 to size, thus facilitating the length-adjustability of the LED assembly 150 to be mounted therein. Alternatively, custom-length housings may otherwise be manufactured and/or assembled, as will be readily appreciated by the skilled artisan.

The LED assembly 150 in this particular embodiment consists of two LED modules or cartridges, namely a fixed unit 152 and an adjustable unit 154, whereby an adjustable overlap between these units allows for the overall length of the LED assembly 150 to be adjusted. Each LED unit comprises one or more LED boards, such as boards 156 and 166, comprising a plurality of LEDs 158 operatively mounted thereon along their respective lengths. In some embodiments, LEDs 158 on each LED board 156, 166 are mounted in accordance with a same designated array. For example, in this particular embodiment, each LED board 156, 166 is identical to the other, thereby allowing to maintain a substantially continuous output from unit to unit, conducive to providing a substantially uniform output along the entire length of the assembly 150.

In this embodiment, the fixed unit 152 comprises three LED boards 156 juxtaposed endwise along a substantially flat LED support surface 159 defined along the length of the fixed unit's base, which may double as a heat sink for the LED board 156. Respective housing engagement surfaces 160 run on either side of the LED mounting surface, and in this particular embodiment, extend continuously therefrom in a single plane, to rest and be fastened upon the support rails 108 via a series of preset fastening holes 162 defined along the length of each engagement surface 160.

In this particular embodiment, the fixed unit 152 is generally defined by a U-shaped structure, the base thereof defining the continuous LED support surface 159 and respective engagement surfaces 160, and further defining on either side thereof and projecting substantially upwardly and continuously therefrom a pair of output reflectors 164 shaped and sized to extend toward the output optics 106 and redirect light generated by the LEDs 158 toward this output. Accordingly, in this particular embodiment, the U-shaped structure will generally be manufactured of, or uniformly coated with a reflective material to provide enhanced output of LED luminance. Alternatively, one or more additional reflectors may be mounted within the housing, for example on either side of the LED boards 156, to provide a similar effect.

Each string of LEDs 158 is generally powered in parallel with each other string so to provide a same set string voltage thereto, and that both in respect of each string on a same LED board 156, and that of each other LED board 156 on the unit 152. Inter-board connections are provided, for example, via power couplings 157, which convey power from an external power source (not shown), which conveyed power is generally controlled by one or more controllers and/or other such hardware, firmware and/or software modules (also not shown) integrally or otherwise operatively coupled between the power source and LED boards 156. Other wiring, powering and control methods and configurations will be readily apparent to the person of ordinary skill in the art in providing a similar effect, and are therefore deemed to fall within the general scope and nature of the present disclosure.

The adjustable unit 154 generally comprises a single LED board 166, in this embodiment identical to LED boards 156 of the fixed unit 152. The LED board 166 is mounted along a substantially flat LED support surface 168 defined along the length of the adjustable unit's base, which again may double as a heat sink for the LED board 166. In this particular embodiment, an additional (optional) heat sink 170 is mounted upon the reverse side of the LED support surface 168 to provide additional heat sinking for the LED board 166, for instance when operating with high power LEDs, and/or to accommodate additional heat generated by a subset of these LEDs overlapped by a portion of the fixed unit 152. Clearly, different heat sinking materials and/or configurations may be considered to provide a desired effect, which may include, but are not limited to, a finned head sink 170 as shown, a basic heat sinking plate or structure, or again a combination of heat sink and powered ventilation system, to name a few.

Once again, respective housing engagement surfaces 172 run on either side of the LED mounting surface 168. In this case, however, the LED support surface 168 is vertically recessed or stepped down relative to the housing engagement surfaces 172 by way of longitudinally spaced-apart vertical mounting structures 174 defining one or more vertical openings 176 therebetween providing open access to a substantially planar gap thus defined between the overlapping segments of units 152 and 154. Accordingly, the engagement surfaces 172, upon resting and being fastened upon the support rails 108 via a series of preset fastening holes 178 defined along the length of each engagement surface 172, allows for the LED support surface 168 of the adjustable unit 154 to effectively hang down relative thereto and thereby facilitate overlap assembly.

Figure 3:
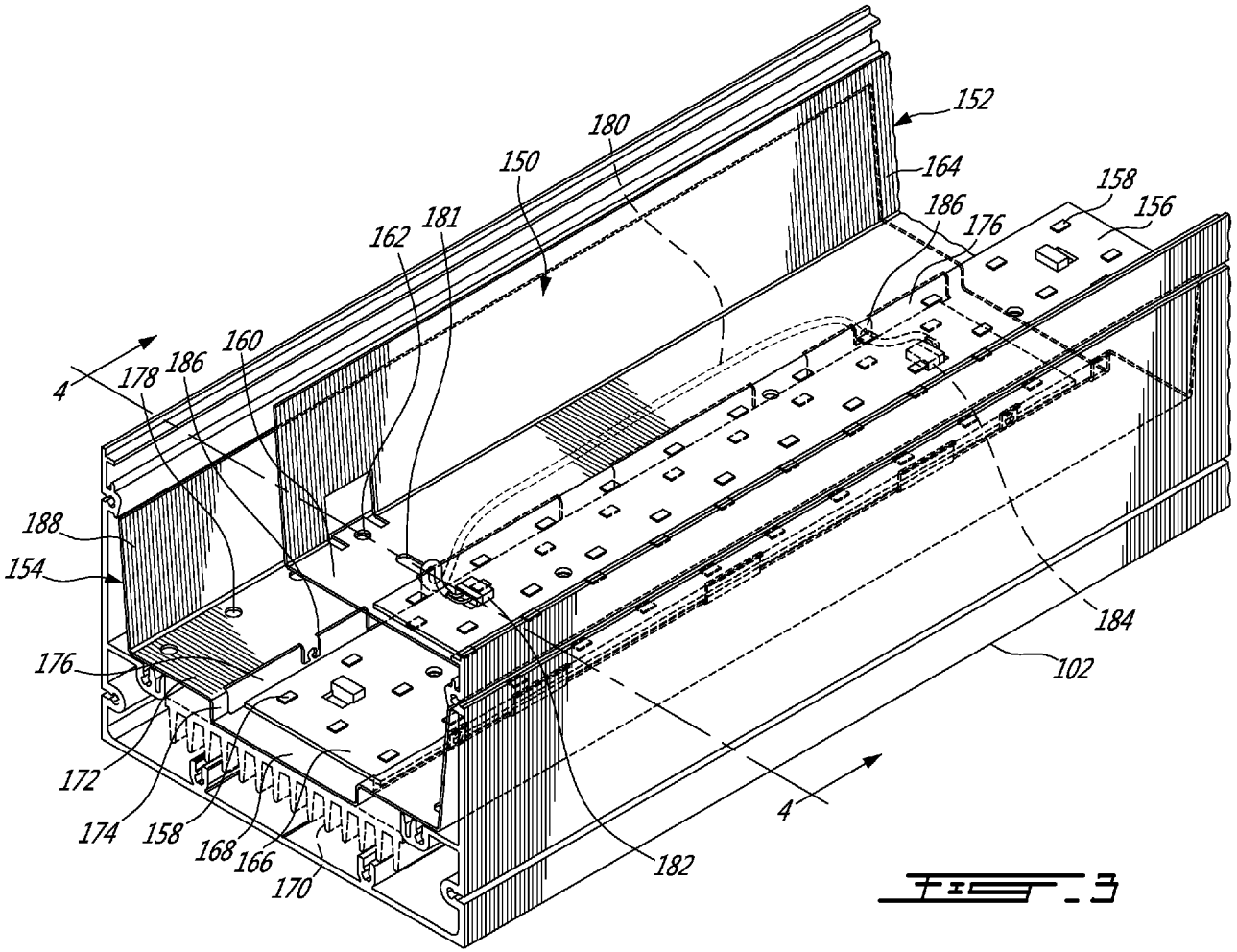
FIG. 3 is a perspective view of an overlapping segment of the optical system of FIG. 1, showing an overlap between LED units thereof and wiring therebetween.

With added reference to FIG. 3, and in accordance with one embodiment, engagement surfaces 172 and 160 are mounted to the support rails 108 of the housing 102 in sliding overlapping engagement, such that, upon adjusting the length of the underlapping adjustable unit 154 extending from the fixed unit 152, an overall length of the LED assembly 150 can also be adjusted. In this particular embodiment, the fastening holes 178 are disposed along the length of the adjustable unit 154 so to align with the fastening holes 162 of the fixed unit 152 and thus be jointly used to fasten both units in overlapping engagement. To maintain a substantially continuous LED array irrespective of the adjusted overall length of the assembly 150, the series of fastening holes 178 are linearly distanced as a function of LED array spacing such that, upon overlapping a selected one of this series and a fastening hole of the fixed unit 154 in jointly fastening the units to the housing's mounting rails 108, a periodicity of the LED's designated array is substantially maintained over the combined length of the LED assembly. For example, in one embodiment, the lengthwise distance between fastening holes 178 is set to be about equal to the pitch distance between LEDs, thereby discretely adjusting the length of the LED assembly 150 to substantially maintain this pitch across the LED unit overlap. Depending on the application at hand, however, it may be practicable to provide even finer adjustment to the LED assembly length, for example down to about ½ pitch distance between LEDs, while substantially maintaining a continuous output across overlapping LED units. These and other such permutations should be readily apparent to the person of ordinary skill in the art, and therefore intended to fall within the general scope and nature of the present disclosure.

With continued reference to FIG. 3, the vertical openings 176 may allow for improved ventilation of the overlapping segments of units 152 and 154, as well as facilitate wiring between these segments. For example, a power coupling 180 between the fixed unit 152 and adjustable unit 154 may be facilitated by feeding this coupling 180 through an oblong aperture 181 defined within the engagement surface 172 of the fixed unit and aligned with an LED board output 182, along the outside of the adjustable unit's recessed vertical supports 174, and through a selected vertical opening 176 aligned with an LED board input 184 of the adjustable unit 154. In this particular example, a wire passage structure 186 extending vertically within the selected opening 176 is provided to better align the coupling 180 with its intended destination, thus reducing the risk of this coupling resting atop a given LED and potentially causing additional heat and/or damage to the coupling and/or LED. As between LED boards 156 mounted on a same or distinct fixed units 152, each string of LEDs on the adjustable unit's LED board will be connected in parallel with each other string, thus providing a substantially same set LED string voltage thereto.

In this particular embodiment, the adjustable unit 154 is also generally defined by a U-shaped structure, the base thereof defining the recessed LED support surface 168 and respective engagement surfaces 172, and further defining on either side thereof and projecting substantially upwardly and continuously therefrom a pair of output reflectors 188 shaped and sized to extend toward the output optics 106 and redirect light generated by the LEDs 158 toward this output. In this case, the output reflectors 164 are substantially nested within output reflectors 188 in sliding overlapping engagement, thus providing a substantially continuous output reflector along the combined length of the LED assembly 150. The U-shaped structure of the adjustable unit 154 may again be manufactured of, or uniformly coated with a reflective material to provide enhanced output of LED luminance. Alternatively, one or more additional reflectors may be mounted within the housing, for example on either side of the LED boards 156, 166, to provide a similar effect.

Figure 4:
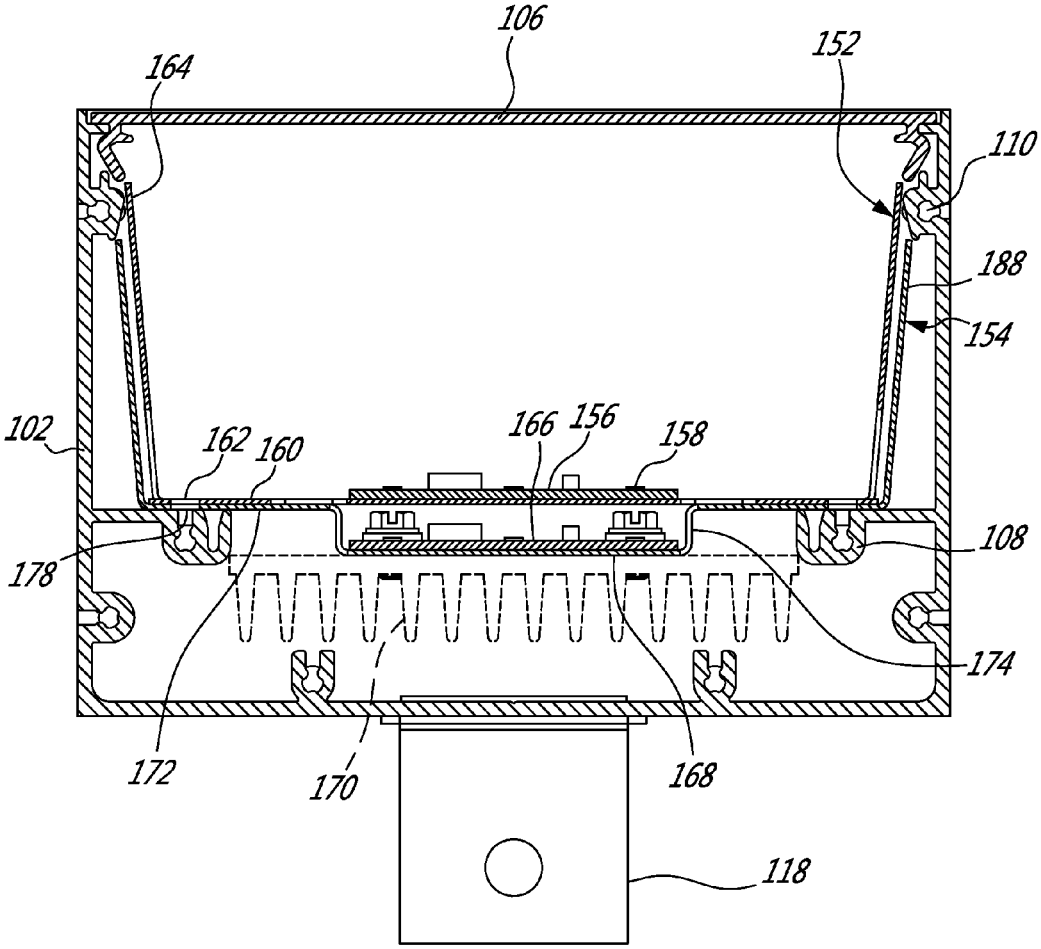
FIG. 4 is an endwise cross section of the overlapping segment of FIG. 3, taken along line 4-4 thereof.
Figure 5:
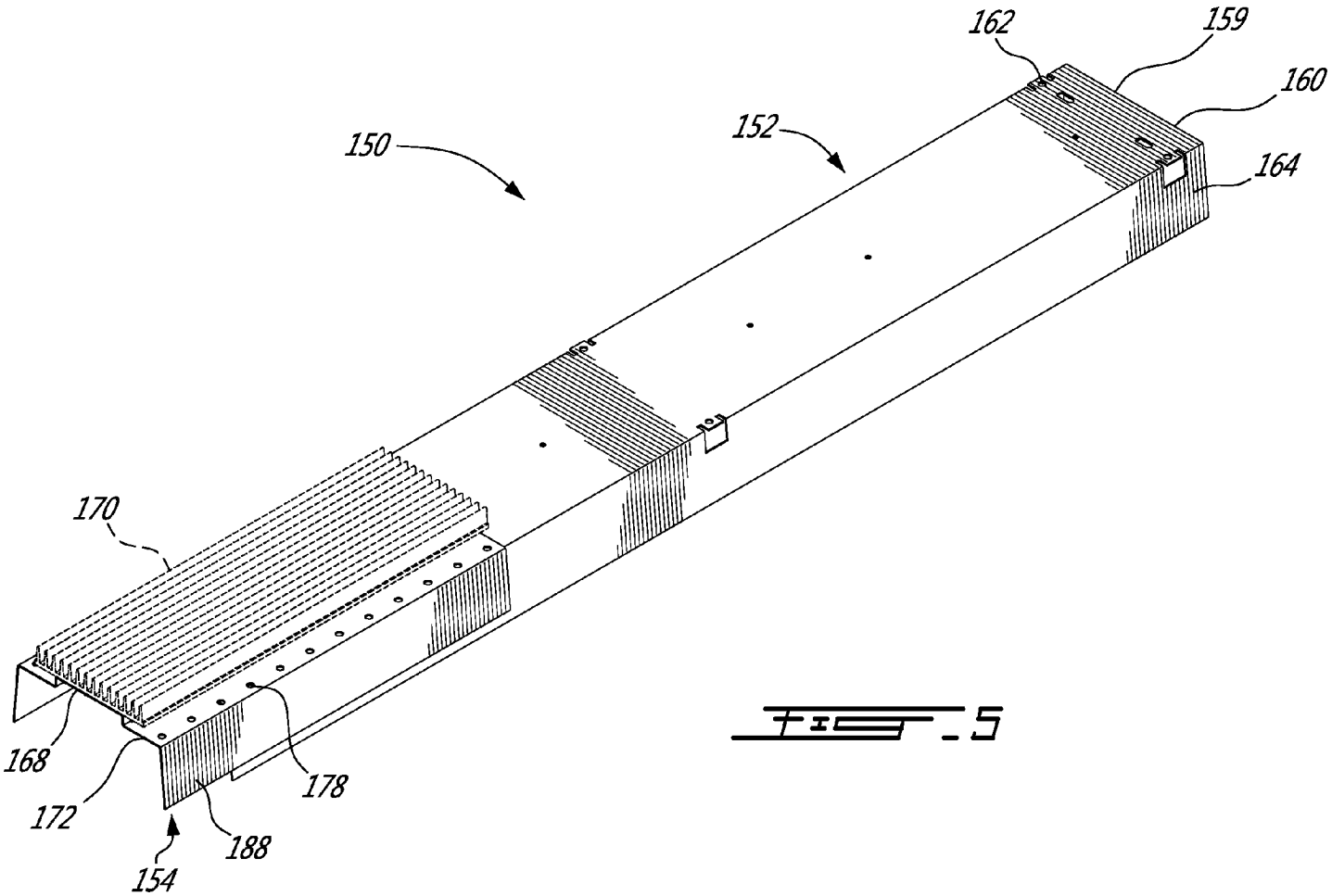
FIG. 5 is a perspective view of the adjustable LED assembly of FIG. 1, as seen from below.

With particular reference to FIGS. 4 and 5, a nesting of the LED units 152 and 154 can be seen in greater detail, whereby LED unit 152 is nested or generally disposed in sliding overlapping engagement relative to the LED unit 154, thus providing for a generally telescoping assembly that allows the overall combined length of the assembly 150 to be adjusted to accommodate different length applications. As introduced above, the LED support surface 159 of the fixed or first LED unit 152 extends substantially continuously into adjacently running engagement surfaces 160 that are, along respective lateral edges thereof, supported by and secured to the housing rails 108, and which lead to upwardly projecting reflectors 164. Recessed LED board 166 is disposed on its support surface 168 below LED support surface 160 to define a substantially planar gap therebetween, and is supported in this configuration by engagement of surfaces 172 to support rails 108 via vertical support structures 174. Adjustable unit reflectors 188 are shown to project upward alongside and external to fixed unit reflectors 164. As best seen in this figure, the engagement surfaces 160 and 172 of both LED units 152 and 154 are jointly fastened to the support rail 108 via alignment of a given fixed unit fastening hole 162 and a selected one of the adjustable unit fastening holes 178. A snap-fit engagement of the output optics 106 to the housing 102 is also readily observable in FIG. 4, as is exemplary mounting bracket 118, shown for illustrative purposes only.

With reference again to FIG. 1, and in accordance with one embodiment of the invention, the end caps 104 may be manufactured of, or coated with, a reflective material so to redirect light directed thereon toward the output optics 106. This feature may, in some embodiments, allow to compensate for the slightly lowered or recessed optics of the adjustable unit 154, thus increasing a homogeneity of the of optical system's overall output over its entire length.

As will be appreciated by the skilled artisan, while the above described embodiments contemplate the provision of a recessed LED board on the adjustable unit 154, a similar embodiment may rather include a raised adjustable unit LED board to be mounted above, rather than below, a corresponding board on the fixed unit(s). Similarly, a substantially flat-bottomed adjustable unit may rather be mounted to overlap a fixed unit having a recessed LED board, or again to underlap a fixed unit having a raised LED board. As will be appreciated by the skilled artisan, different raised and recessed LED unit designs and combinations may be considered to provide a similar effect, namely to accommodate a substantially planar gap between overlapping segments, and that, without departing from the general scope and nature of the present disclosure.

Figure 6:
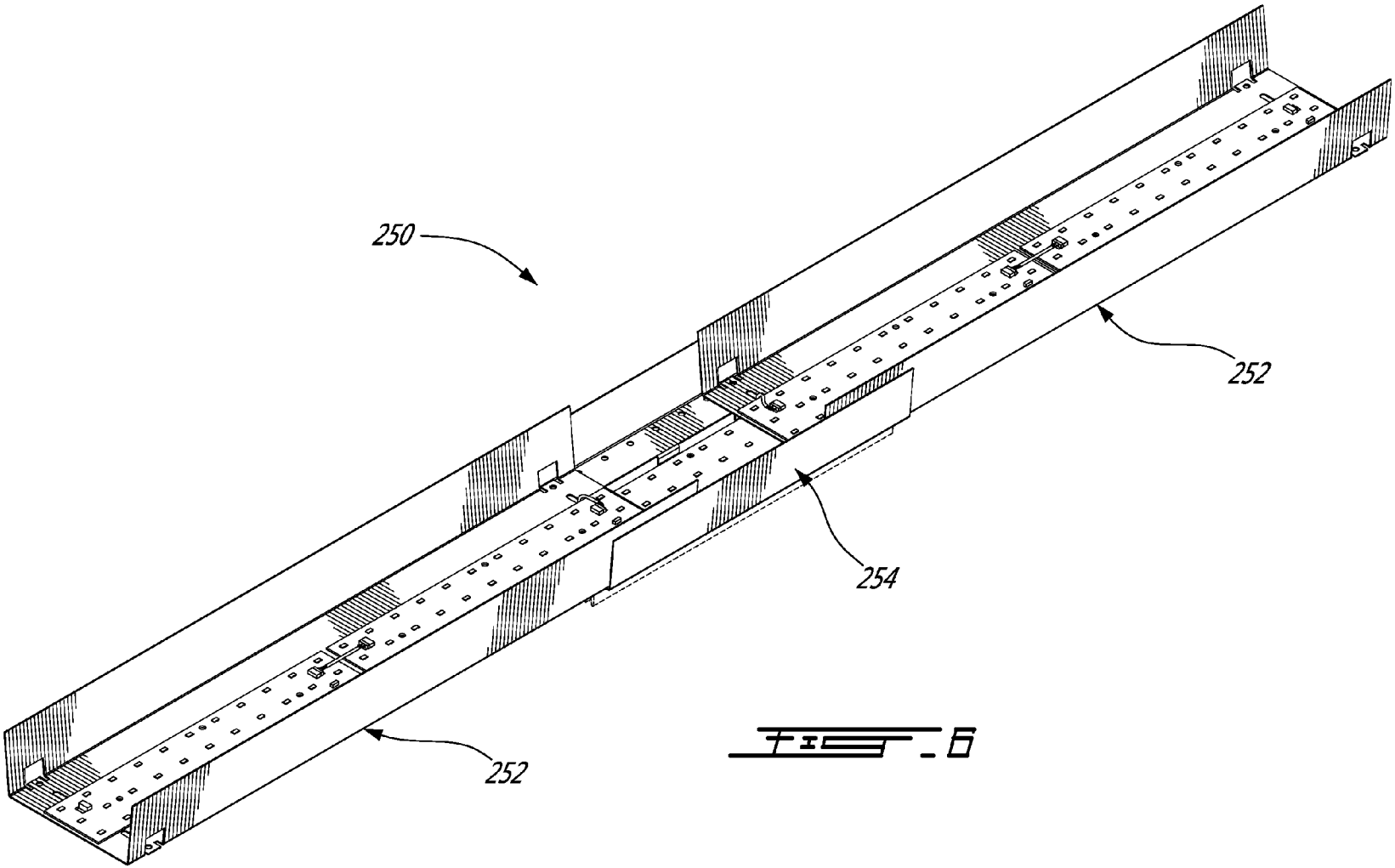
FIG. 6 is a perspective view of an alternative adjustable LED assembly, in accordance with another embodiment of the invention.

With reference now to FIG. 6, and in accordance with an alternative embodiment of the invention, an LED assembly 250 is shown to include two fixed-length LED units 252 and an adjustable LED unit 254 disposed intermediately in sliding overlapping engagement with both fixed units 252. Other than the position of the adjustable unit 254 relative to the fixed units 252, the parts and configurations of this embodiment are substantially identical to those of assembly 150 shown in FIGS. 1 to 5.

Figure 7:
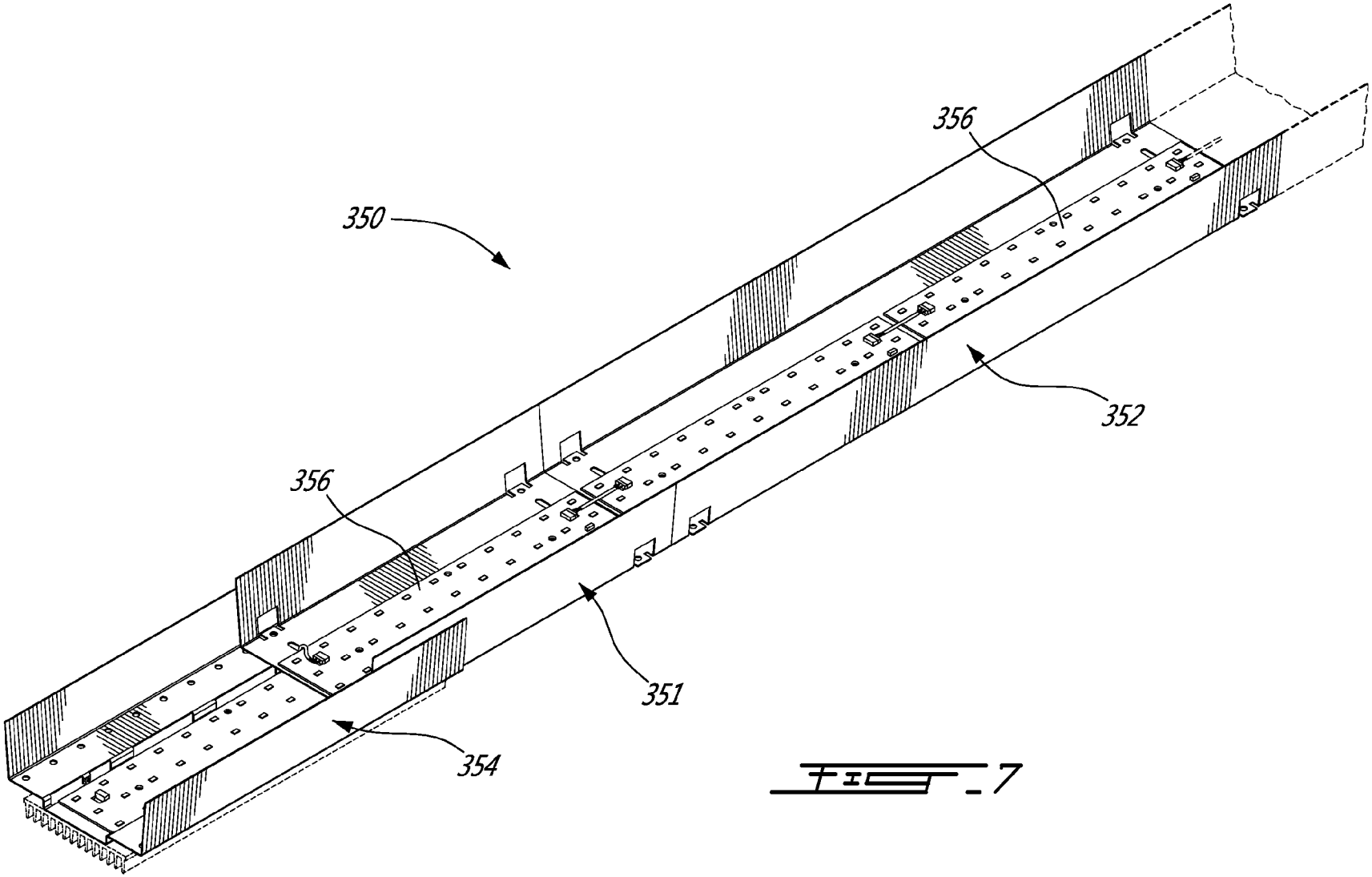
FIG. 7 is a perspective view of an alternative adjustable LED assembly, in accordance with yet another embodiment of the invention.

With reference to FIG. 7, and in accordance with yet another alternative embodiment of the invention, an LED assembly 350 is shown to include an expandable set of fixed-length LED units, showing in this example a first unit 351 having a single LED board 356, a second unit 352 having two LED boards 356 juxtaposed endwise relative thereto, and option for a third or more LED boards to be further juxtaposed endwise relative thereto in providing a discretely extendable fixed-length assembly. A length adjustable unit 354 is also provided in sliding overlapping engagement with the first fixed unit 351, in similar fashion as adjustable unit 154 and fixed unit 152 described in respect of the embodiments shown in FIGS. 1 to 5. Accordingly, the LED assembly 350 may be configured to accommodate different lengths, both on a large scale in aligning multiple fixed-length units such as units 351 and 352, some of which potentially of different respective overall lengths, and on a reduced scale upon adjusting an effective length of the adjustable unit 354. As will be appreciated by the skilled artisan, different housings may be configured to accommodate different assembly lengths, be they manufactured of a single structure, or assembled themselves end-to-end and optionally trimmed or cut to length.

As will be appreciated by the skilled artisan, the general size and shape of the various components of the above-described LED assemblies, and optical systems comprising same, may be varied without departing from the general scope and nature of the present disclosure. It will also be appreciated that general references to system and component orientations are provided for illustrative purposes only, as these systems and components may be reoriented and/or reconfigured depending on the intended application(s) for which they are manufactured and/or assembled, and that, without departing from the general scope and nature of the present disclosure.

For example, while the above illustrative embodiments contemplate various length-adjustable light sources, the scope of the present disclosure should not be construed to be limited as such, as other embodiments may be readily applied to width or otherwise adjustable configurations, for instance, in accommodating different applications for which the light source is being manufactured and/or designed, different LED board layouts, LED densities and/or fixture needs, to name a few. For example, the provision of side-by-side LED modules configured for widthwise overlapping engagement may also be considered to accommodate customized light source widths, as can other permutations such as diagonally telescoping modules, or again curved or arcuate modules shaped and sized for sliding overlapping engagement in a substantially linear, albeit curved, configuration. It will be further appreciated that while a single adjustable assembly is provided in the above embodiments in a shape and size corresponding with a particular housing, multiple assemblies may alternatively be fitted within a given housing to provide a different effect or output, or again, a single assembly may be operatively mounted within a distinctly shaped housing, for example. These and other such permutations should be readily apparent to the person of ordinary skill in the art, and are therefore deemed to fall within the general scope and nature of the present disclosure.

Further, it will be appreciated that different LED types and/or technologies may be considered in the manufacturing and assembly of the above-described and similarly configured embodiments to produce different outputs, be they in respect of different LED output colours, intensities and/or distributions, or again manufactured of different materials or the like. For example, while LED arrays are provided in the illustrated embodiments within the context of prefabricated LED boards, other LED configurations may be readily applied without departing from the general scope and nature of the present disclosure. For example, one or more arrays of LEDs may be operatively mounted on different fixed and/or adjustable LED modules to provide a similar effect, as can distinct LED boards be mounted in different positions and/or configurations relative to their respective module mounting structures and/or surfaces.

Further various overall mounting hardware and/or configurations may also be considered, whether hanging from a wall or ceiling, recessed within a particular structure, wall, ceiling or flooring, or otherwise mounted and secured to provide a desired luminous effect and/or fulfill a desired illuminating purpose. These and other such considerations will be readily apparent to the person of ordinary skill in the art, and are therefore intended to fall within the general scope and nature of the present disclosure.

As will be appreciated by the skilled artisan, some of the embodiments may allow for the manufacture of a length, width or otherwise linearly adjustable LED light source assembly using modular components and, in some examples, using off the shelf LED boards or like components without unduly limiting customizability. For instance, the embodiments described in respect of FIGS. 1 to 7 are generally depicted to make use of standard R3 LED boards manufactured by Philips, though other standard LED components may also be readily utilized within the present context to provide a like effect. For example, the depicted LED boards are shown to include three rows of LEDs, whereas one, two, three or more LED rows may be operatively mounted to each LED board, and that, in different configurations and/or groupings. For instance, LED strings may be spaced closer together, or again linearly staggered to provide different optical outputs depending on the intended application. Similarly, while the adjustable unit and fixed unit in these embodiments are shown to make use of identical boards, a shorter board, for example, may be used in some embodiments for the adjustable unit in order to minimize loss generated by overlap otherwise applicable when using longer adjustable unit LED boards, albeit potentially in exchange for a potential loss in adjustability. Also, by adjusting the number of LED strings per board, or alternatively adjusting the lateral spacing between such strings, different board widths may allow for different lighting system dimensions, for example, but not limited to, embodiments ranging from ½ inch to 12 inches in width. In yet another configuration, two or more LED boards may be disposed side by side on a same unit, for example. These and other such variations should be readily apparent to the person of ordinary skill in the art, and are therefore deemed to fall within the general scope and nature of the present disclosure. Clearly, and as noted above, the embodiments of the invention herein described should not be limited to the use of linear LED boards, but can rather be manufactured using different LED technologies, configurations and positioning schemes depending on the intended purpose of the final product, as will be readily apparent to the person of ordinary skill in the art.

As noted above, different materials may be used to manufacture the above-described and other such embodiments. For example, the housing can be manufactured of shaped steel or aluminum, and cut to size to provide a continuous housing. In other embodiments, the housing may rather be extruded from a selected material, and again, either cut or manufactured to size depending on the intended application. In other embodiments, the housing may be assembled from different segments, for instance where a particularly long optical system is being designed. Alternatively, the housing may be shaped, sized and/or assembled to provide an overall design that, while encompassing one or more adjustable LED assemblies as described herein, is not correspondingly shaped or configured. For example, a distinctly shaped housing may nonetheless provide appropriate mounting features or structures (e.g. appropriate rails or the like) for allowing structural mounting of the one or more LED assemblies in a preset configuration, for example.

As for the LED units, it will be appreciated that different materials can also be used to form the U-shaped structures described above, for example, and other LED mounting structures serving the similar functions and thus falling within the general scope and nature of the present disclosure. In one embodiment, each U-shaped structure or cartridge consists of a white-coated steel or aluminum cartridge providing both for LED board support and installation within the housing, but also doubling as an output reflector, as described above. Again, different permutations to the above examples will be readily apparent to the person of ordinary skill in the art, and are therefore deemed to fall within the general scope and nature of the present disclosure.

While the present disclosure describes various exemplary embodiments, the disclosure is not so limited. To the contrary, the disclosure is intended to cover various modifications and equivalent arrangements included within the general spirit and scope of the present disclosure.

The invention claimed is:

1. An optical system comprising:

a first LED module comprising a plurality of LEDs operatively mounted thereon in accordance with a designated array; and a second LED module comprising a plurality of LEDs operatively mounted thereon in accordance with said designated array;

said second LED module adjustably fixable relative to said first LED module in sliding overlapping relationship to provide an adjustable extension thereto and substantially continuously maintain an optical output over a combination of said first LED module and said second LED module.

2. The optical system of claim 1, further comprising:

a housing;

each said LED module comprising an LED supporting surface to provide support for its corresponding LEDs, and an LED mounting structure for structurally coupling said supporting surface to said housing;

wherein said LED mounting structure of said second LED module is shaped and sized relative to said LED mounting structure of said first LED module unit such that mounting each said LED module to said housing in said sliding overlapping relationship defines a substantially planar gap between overlapping segments of said first LED module and said second LED module.

3. The optical system of claim 2:

said housing having a substantially continuous mounting structure defined therein;

said LED mounting structure of each said LED module disposed alongside its corresponding LED supporting surface and structurally mounted in an at least partially overlapping relationship relative to one another to said substantially continuous mounting structure of said housing;

said LED mounting structure of said second LED module being shaped and sized to define a vertical spacing between its corresponding LED supporting surface and said mounting structure of said housing different from a corresponding vertical spacing defined by said LED mounting structure of said first LED module so to define said substantially planar gap.

4. The optical system of claim 3:

said housing comprising opposed inner mounting rails;

each said LED mounting structure defining engagement surfaces running along and on either side of its corresponding LED supporting surface for engagement with said mounting rails;

wherein said engagement surfaces of said second LED module are adjustably fixable in sliding overlapping engagement with said engagement surfaces of said first LED module.

5. The optical system of claim 4, said engagement surfaces of said first LED module comprising a fixed set of fastening holes for fastening same to said mounting rails;

said engagement surfaces of said second LED module each comprising a series of fastening holes linearly distanced as a function of an LED array spacing such that, upon overlapping a selected one of said series and one of said fixed set in jointly fastening said first and said second LED module to said mounting rails, a periodicity of said designated array is substantially maintained over said combination.

6. The optical system of claim 3, said supporting surface of at least one said LED module being vertically spaced relative to said mounting structure of said housing via a set of longitudinally spaced-apart vertical mounting structures defining one or more vertical openings therebetween providing open access to said substantially planar gap, wherein said one or more vertical openings allow for ventilation of said overlapping segments.

7. The optical system of claim 3, said supporting surface of at least one said LED module being vertically spaced relative to said mounting structure of said housing via a set of longitudinally spaced-apart vertical mounting structures defining one or more vertical openings therebetween providing open access to said substantially planar gap, the system further comprising wiring operatively coupling said overlapping segments, said one or more vertical openings allowing for passage of said wiring from one of said overlapping segments to the other.

8. The optical system of claim 7, further comprising a wire passage structure extending vertically within one or more of said openings and aligned with a wire coupling of an underlapping one of said overlapping segments.

9. The optical system of claim 2, further comprising:

a substantially continuous output optics structurally coupled to said housing;

each said LED module comprising an output reflector for redirecting light generated by its corresponding LEDs toward said output optics, said output reflector of said first LED module mounted in sliding overlapping engagement with said output reflector of said second LED module in providing a substantially continuous output reflector along said combination.

10. The optical system of claim 9, further comprising an additional reflector disposed laterally across said housing toward an end thereof at which is mounted an underlapping one of said LED boards for redirecting light generated thereby toward said output optics.

11. The optical system of claim 9, each said LED module comprising a substantially U-shaped structure, wherein a base of said U-shaped structure defines said LED supporting surface and further defines said supporting structure along either side of said LED supporting surface, and wherein upwardly extending arms of said U-shaped structure defines said output reflectors, said U-shaped structure of each said LED module correspondingly shaped and sized for telescoping engagement within said housing.

12. The optical system of claim 11, wherein said LED supporting surface of said second LED module is stepped down relative to its corresponding mounting structure and mounted in underlapping relationship with said LED supporting surface of said first LED module so to define said substantially planar gap.

13. The optical system of claim 1, said second LED module adjustably fixable relative to said first LED module in discrete length increments preset to substantially continuously maintain a periodicity of said designated array over said combination.

14. A modular LED light source comprising:

a housing having a corresponding output optics;

one or more fixed LED modules juxtaposed within said housing, each having a designated dimension and comprising a plurality of LEDs operatively mounted thereon in accordance with a designated array;

an adjustable LED module having a designated dimension and comprising a corresponding array of LEDs operatively mounted thereon, said adjustable LED module adjustably fixed in sliding overlapping engagement relative to said fixed LED modules in providing a linearly adjustable extension to said designated LED array.

15. The LED light source of claim 14, further comprising:

wiring sequentially interconnecting said adjustable module and said one or more fixed modules to a common controller disposed within said housing.

16. The LED light source of claim 14:

each of said fixed modules and said adjustable module comprising an LED mounting surface and a housing engagement surface running along either side thereof, corresponding housing engagement surfaces of said fixed and adjustable modules being mounted to said housing in sliding overlapping engagement;

said LED mounting surface of at least one of said adjustable module and said one or more fixed modules being vertically spaced relative to its corresponding housing engagement surface such that, upon said sliding overlapping engagement between said corresponding housing engagement surfaces, a substantially planar spacing is defined between overlapping LED mounting surface segments.

17. The light source of claim 16, wherein said LED mounting surface of said adjustable module is stepped down relative to its corresponding housing engagement surface and mounted in underlapping relationship with said LED mounting surface of said one or more fixed modules so to define said substantially planar gap.

18. The light source of claim 14, each of said adjustable module and said one or more fixed modules comprising an output reflector for redirecting light generated by its corresponding LEDs toward said output optics, said output reflector of said adjustable module and of said one or more fixed modules mounted in sliding overlapping engagement in providing a substantially continuous output reflector along said housing.

19. The light source of claim 14:

each of said adjustable module and said one or more fixed modules comprising a substantially U-shaped structure, a base of said U-shaped structure having said LEDs operatively mounted thereon, whereas upwardly extending arms of said U-shaped structure providing output reflectors for said LEDs;

said U-shaped structure of said adjustable module correspondingly shaped and sized for telescoping engagement with said U-shaped structure of said one or more fixed module within said housing.

20. The light source of claim 19, said U-shaped structure of said adjustable module having a stepped down base and being mounted in underlapping relationship with said one or more fixed modules so to define a substantially planar gap therebetween to accommodate said telescoping engagement in providing a vertical spacing above LEDs mounted on an underlapping segment of said adjustable module.

21. A method for assembling a modular light source, comprising:

locating an adjustable LED module at a first end within a light source housing having a given dimension, said adjustable LED module having a designated dimension and comprising an array of LEDs operatively mounted thereon recessed relative to adjustable housing engagement surfaces provided along either side thereof;

locating one or more fixed LED modules juxtaposed from a second end of said housing, each having a designated dimension and comprising a corresponding array of LEDs operatively mounted thereon coplanar to fixed housing engagement surfaces provided along either side thereof, said fixed housing engagement surfaces located within said housing in sliding overlapping engagement with said adjustable housing engagement surfaces, thereby defining a substantially planar gap above underlapping LEDs of said adjustable module;

securing said adjustable and fixed LED modules in overlapping engagement within said housing to accommodate said given dimension of said housing.

22. The method of claim 21, further comprising prior to said securing:

adjusting a relative location of said adjustable module and said one or more fixed modules as a function of preset intervals to provide a substantially continuous LED output along said given dimension of said housing.

* * * * *